US010532606B1

(12) United States Patent
Gray

(10) Patent No.: US 10,532,606 B1
(45) Date of Patent: Jan. 14, 2020

(54) DECORATIVE ARTWORK MOUNT FOR DECKS

(71) Applicant: Rodger Francis Gray, Linthicum Heights, MD (US)

(72) Inventor: Rodger Francis Gray, Linthicum Heights, MD (US)

( * ) Notice: Subject to any disclaimer, the term of this patent is extended or adjusted under 35 U.S.C. 154(b) by 0 days.

(21) Appl. No.: 16/194,836

(22) Filed: Nov. 19, 2018

Related U.S. Application Data

(60) Provisional application No. 62/718,140, filed on Aug. 13, 2018.

(51) Int. Cl.
*A47G 1/06* (2006.01)
*B44C 5/04* (2006.01)
*B44C 5/02* (2006.01)

(52) U.S. Cl.
CPC ..... *B44C 5/04* (2013.01); *A47G 1/0627* (2013.01); *B44C 5/02* (2013.01); *A47G 2001/0666* (2013.01); *A47G 2001/0677* (2013.01)

(58) Field of Classification Search
CPC ..... B44C 5/04; B44C 5/02; A47G 1/0627; A47G 2001/0666; A47G 2001/0677
See application file for complete search history.

(56) References Cited

U.S. PATENT DOCUMENTS 2,353,469 A * 7/1944 Hopp ..... G09F 3/20 40/650
3,579,886 A 5/1971 Hughes et al.
3,742,633 A * 7/1973 Palm ..... G09F 7/08 40/576
3,745,680 A 7/1973 Faust
3,829,998 A * 8/1974 Flax ..... B42D 15/042 40/800
3,879,873 A 4/1975 Sawyer
4,216,597 A 8/1980 Kocina et al.
4,258,488 A * 3/1981 Schienbein ..... A47G 1/06 40/124.2
4,368,584 A 1/1983 Logan
4,641,441 A 2/1987 Roth
4,884,353 A * 12/1989 Taylor ..... G09F 7/08 40/611.01
4,998,363 A 3/1991 Vilims
5,323,551 A 6/1994 Lovison et al.
5,524,370 A 6/1996 Roy
6,298,593 B1 10/2001 Vilims et al.
(Continued)

FOREIGN PATENT DOCUMENTS

FR 1267492 A * 7/1961 ..... A47G 1/142
FR 2499839 A1 * 8/1982 ..... A47G 1/06

*Primary Examiner* — Cassandra Davis
(74) *Attorney, Agent, or Firm* — Dunlap Bennett & Ludwig PLLC

(57) ABSTRACT

A decorative mount includes at least a frame and a decorative plate. The frame includes a base, a sidewall extending from a front surface of the base, and a first pair of slots defined on opposing sides of an inner surface of the sidewall and spaced away from the base. The decorative plate is made of a flexible and resilient material and includes a front surface having a decoration, a rear surface, an outer edge, and a pair of plate tabs extending from opposing sides of the outer edge. The pair of plate tabs fit within the first pair of slots releasably retaining the decorative plate to the frame. A space is defined between the decorative plate and the base.

8 Claims, 3 Drawing Sheets

(56) References Cited

U.S. PATENT DOCUMENTS

| | | | | |
|---|---|---|---|---|
| 6,653,931 | B2 * | 11/2003 | Chiang | A47G 1/0616 340/286.05 |
| 7,802,390 | B2 | 9/2010 | Reis | |
| 7,934,331 | B2 | 5/2011 | Zlotocha | |
| 8,123,254 | B2 | 2/2012 | Conrad et al. | |
| 8,250,798 | B2 | 8/2012 | Roy | |
| 8,365,452 | B2 | 2/2013 | Goldman | |
| 8,418,858 | B2 | 4/2013 | Foltz et al. | |
| 8,495,830 | B2 | 7/2013 | Price | |
| 2004/0134111 | A1 | 7/2004 | Berg | |
| 2005/0016045 | A1 * | 1/2005 | Lasher | A47G 1/06 40/759 |
| 2010/0192437 | A1 * | 8/2010 | Fallander | A47G 1/06 40/790 |
| 2015/0075046 | A1 | 3/2015 | Skinner | |
| 2017/0105551 | A1 | 4/2017 | Forrest et al. | |

* cited by examiner

DECORATIVE ARTWORK MOUNT FOR DECKS

CROSS-REFERENCE TO RELATED APPLICATION

This application claims the benefit of priority of U.S. provisional application number Aug. 13, 2018, filed 62/718,140, the contents of which are herein incorporated by reference.

BACKGROUND OF THE INVENTION

The present invention relates to decorating decks and, more particularly, to a decorative artwork mount for decks.

An exterior deck is a flat surface capable of supporting weight, similar to a floor, but typically constructed outdoors, often elevated from the ground, and usually connected to a building. Exterior decks are made mainly using treated wood and are unadorned. Many homes have beautiful and themed designs. However, the attached decks do not compliment the home decor.

As can be seen, there is a need for a decorative artwork mount for decks that allow users to compliment their home décor.

SUMMARY OF THE INVENTION

In one aspect of the present invention, a decorative mount comprises: a frame comprising a base, a sidewall extending from a front surface of the base, and a first pair of slots defined on opposing sides of an inner surface of the sidewall, spaced away from the base; and a decorative plate made of a flexible and resilient material and comprising a front surface comprising a decoration, a rear surface, an outer edge, and a pair of plate tabs extending from opposing sides of the outer edge, wherein the pair of plate tabs fit within the first pair of slots, releasably retaining the decorative plate to the frame, and a space is defined between the decorative plate and the base.

In another aspect of the present invention, a decorative mount comprises: a frame comprising a base, a sidewall extending from a front surface of the base, and a pair of slots defined on opposing sides of an inner surface of the sidewall, spaced away from the base; and a removal mechanism disposed within the frame beneath the pair of slots and comprising: a support base disposed against the base; a lever arm comprising a first end and a second end; and a pivot pivotably coupling the lever arm to the support base between the first end and the second end of the lever arm.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a decorative artwork/imagery mounted on exterior deck posts and railings. The decorative art or images can be themed and installed on the vertical deck posts and horizontal railings. The present invention includes a frame and interchangeable decorative plates. Deck themes may be offered in many motifs and the customer can enjoy self-expression and the fulfilled compliment to their home using the present invention.

Figure 1:
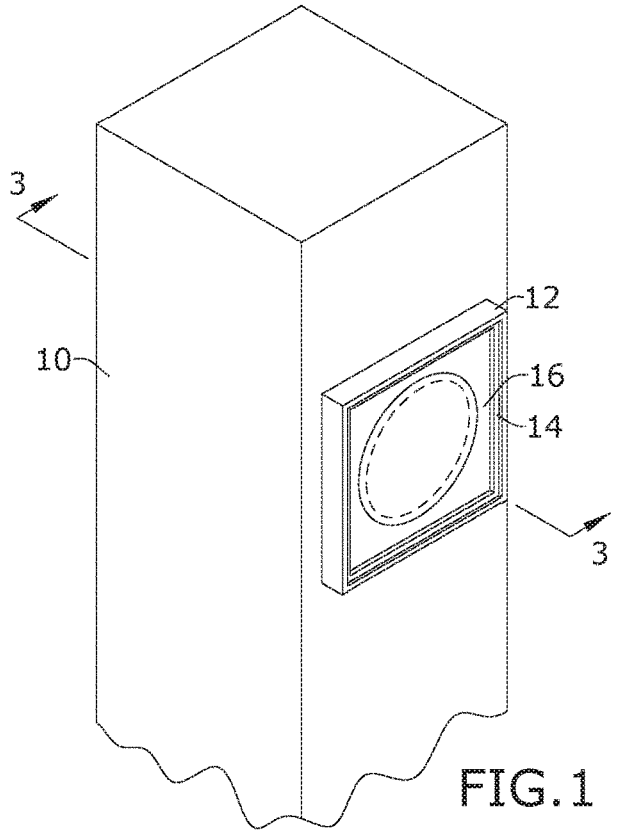
FIG. 1 is a perspective view of an embodiment of the present invention.
Figure 2:
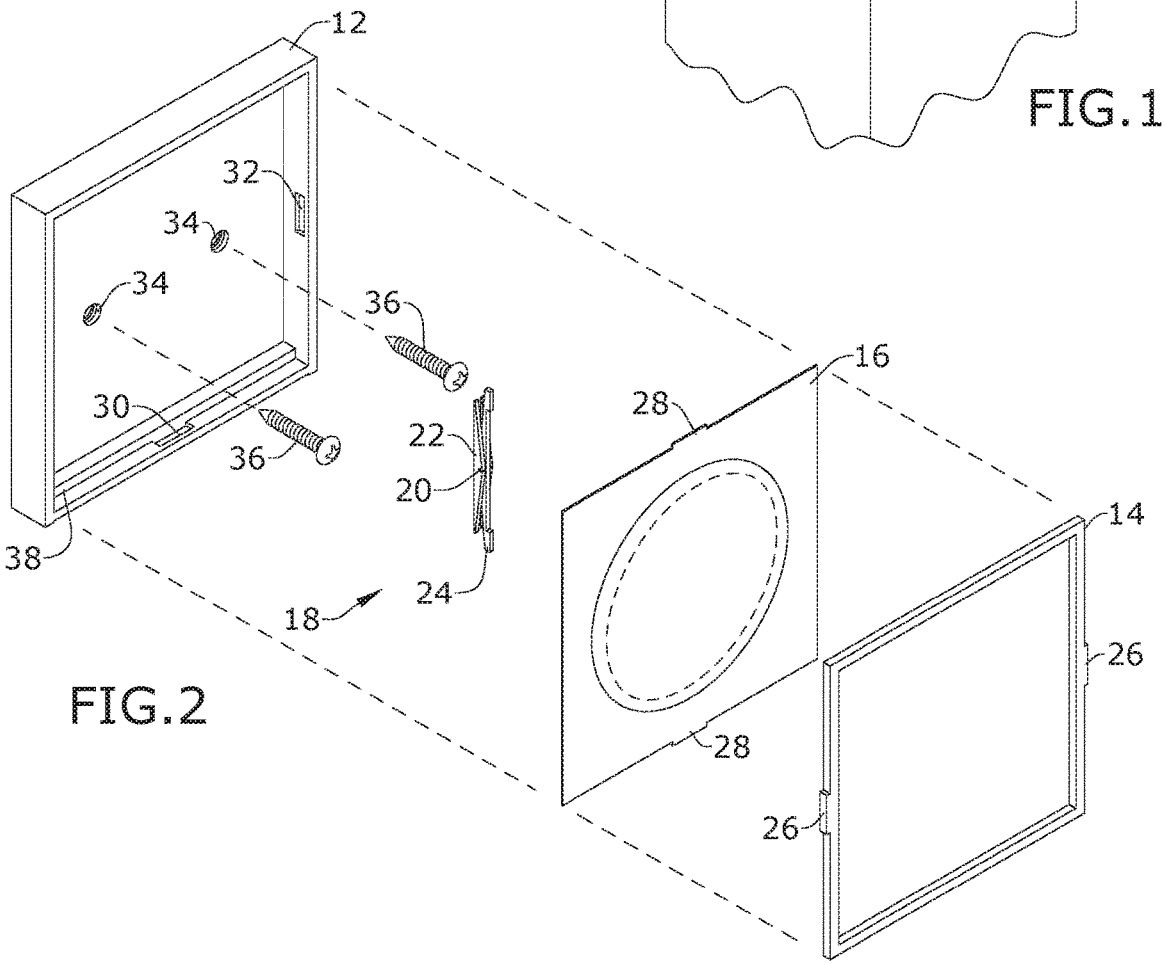
FIG. 2 is an exploded view of an embodiment of the present invention.
Figure 3:
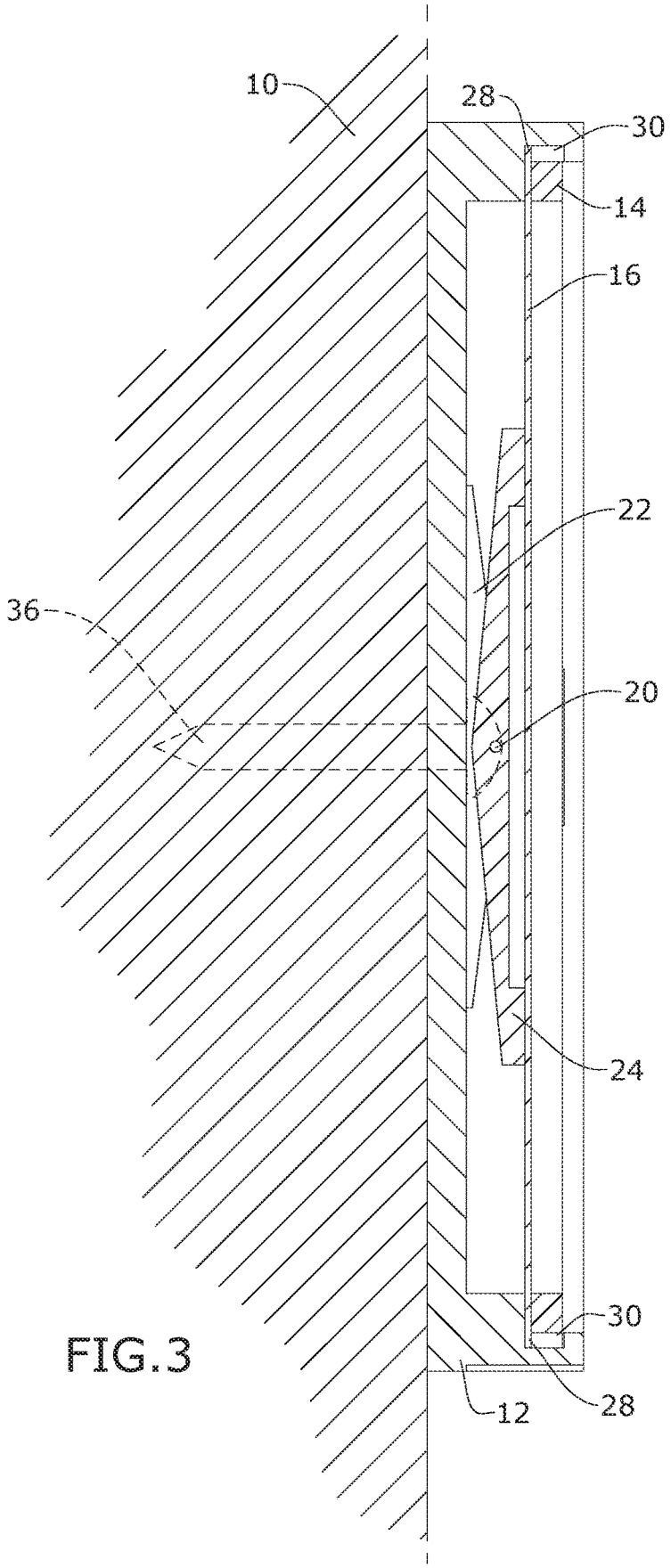
FIG. 3 is a section view of the present invention, taken along line 3-3 in FIG. 1.
Figure 4:
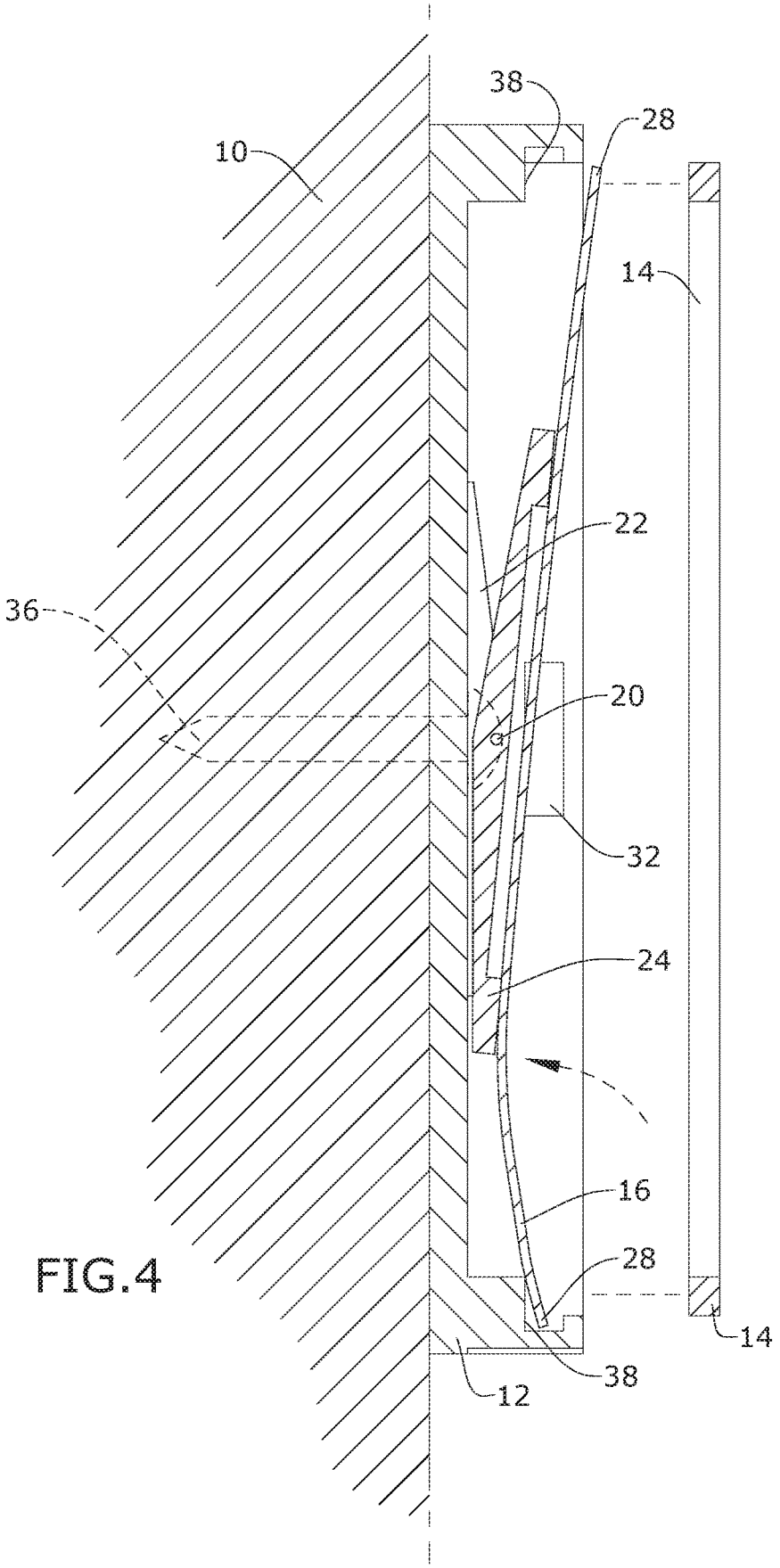
FIG. 4 is a section view of an embodiment of the present invention illustrating a removal of a decorative artwork.

Referring to FIGS. 1 through 4, the present invention includes a decorative mount. The decorative mount includes at least a frame 12 and a decorative plate 16. The frame 12 includes a base, a sidewall extending from a front surface of the base, and a first pair of slots 30 defined on opposing sides of an inner surface of the sidewall and spaced away from the base. The decorative plate 16 is made of a flexible and resilient material and includes a front surface having a decoration, a rear surface, an outer edge, and a pair of plate tabs 28 extending from opposing sides of the outer edge. The pair of plate tabs 28 fit within the first pair of slots 30, releasably retaining the decorative plate 16 to the frame 12. A space is defined between the decorative plate 16 and the base.

As mentioned above, the decorative plate 16 is made of a flexible and resilient material. For example, the decorative plate 16 may be made of plastic or a thin and bendable metal, such as aluminum. Therefore, the decorative plate 16 may be bent to insert into the frame 12 and removed from the frame 12. The decoration may be made by sublimating decorative art/images onto the plastic or aluminum substrate. After the sublimating, the decorating plate 16 may be cut to fit the frame's 12 receptacle size, such as square, rectangular, triangular, circular, and the like. To prolong the usefulness of the decorative plate 16, a UV protectant may be applied to the decoration.

The frame 12 of the present invention may also be made of a plastic or aluminum. In certain embodiments, a ledge 38 extends from at least one of the base and the sidewall of the frame 12. When the decorative plate 16 is inserted into the frame 12, the decorative plate 16 rests against the ledge 12. The frame 12 may have a shape of a square, rectangular, triangular, circular, and the like.

The present invention may further include a decorative trim molding 14. The decorative trim molding 14 includes an inner edge and an outer edge. The inner edge defines an opening providing a clearance for the decoration. A pair of trim tabs 26 extend from opposing sides of the outer edge. The trim tabs 26 fit within a second pair of slots 32 defined on opposing sides of an inner surface of the sidewall, releasably retaining the retainer trim 14 to the frame 12 so that the decorative plate 16 is disposed in between the decorative trim molding 14 and the base. The decorative trim molding 14 is flexible in order to bend and let the tabs 26 to be placed within the second pair of slots 32. The decorative trim molding 14 serves to compliment the imagery features in the decorative plate 16 to the frame 12.

The present invention may further include a removal mechanism 18 disposed within the space between the decorative plate 16 and the frame 12. The removal mechanism 18 includes a support base 22 disposed against or coupled to the base of the frame 12. The removal mechanism 18 further includes a lever arm 24 having a first end and a second end abutting against a back surface of the decorative plate 16 when the decorative plate 16 is releasably retained to the frame 12. A pivot pin 20 pivotably couples the lever arm 12 to the support base 22 at a central portion of the lever arm 12. The removal mechanism 18 allows a user to easily pop the decorative panel 16 out of the frame 12 by pressing against the decorative plate 16 at the first end, pivoting the lever 12 so that the second end urges the decorative plate 16 out of the frame 12.

The present invention may further include a fastener operable to secure the frame 12 to a post 10 of a deck. The fastener may include fastening screws 36 that are driven through openings 34 of the base of the frame 12. The installation is accomplished by using the screws 36 or other typical fasteners, such as nails, to mount the frame 12 to the post 10 or rail of the deck. The user may secure the frame 12 and then change the decorative plates 16 at any time.

In alternate embodiments, the present invention may be used for at hotel swimming pools that have railings or fencing. Local vendors may use the present invention to advertise their goods, sales events, or location of service. The present invention may be used for festivities and celebratory occasions as well, such as 4th of July, Birthdays, Graduations, and the like. The present invention may further be used for promoting professional sports, musicians, and other artists.

It should be understood, of course, that the foregoing relates to exemplary embodiments of the invention and that modifications may be made without departing from the spirit and scope of the invention as set forth in the following claims.

What is claimed is:

1. A decorative mount comprising:

a frame comprising a base, a sidewall extending from a front surface of the base, a first pair of slots defined on first opposing sides of an inner surface of the sidewall and spaced away from the base, and a second pair of slots defined on second opposing sides of the inner surface of the sidewall;

a removal mechanism disposed within the frame beneath the pair of slots and comprising a support base disposed against the base, a lever arm comprising a first end and a second end, and a pivot pivotably coupling the lever arm to the support base between the first end and the second end of the lever arm;

a decorative plate made of a flexible and resilient material and comprising a front surface comprising a decoration, a rear surface, an outer edge, and a pair of plate tabs extending from opposing sides of the outer edge; and a decorative trim molding comprising an inner edge and an outer edge, wherein the inner edge defines an opening providing a clearance for the decoration and a pair of trim tabs extend from opposing sides of the outer edge, wherein the pair of plate tabs fit within the first pair of slots, releasably retaining the decorative plate to the frame, the trim tabs fit within the second pair of slots, releasably retaining the decorative trim molding to the frame so that the decorative plate is disposed in between the decorative trim molding and the base, and a space is defined between the decorative plate and the base.

2. The decorative mount of claim 1, further comprising a ledge extending from at least one of the base and the sidewall, wherein the decorative plate rests against the ledge.

3. The decorative mount of claim 1, wherein the frame and the decorative plate comprise a quadrilateral shape.

4. The decorative mount of claim 1, further comprising a fastener operable to secure the frame to a post of a deck.

5. The decorative mount of claim 4, wherein the fastener comprises fastening screws driven through openings of the base.

6. A decorative mount comprising:

a frame comprising a base, a sidewall extending from a front surface of the base, and a pair of slots defined on opposing sides of an inner surface of the sidewall and spaced away from the base; and a removal mechanism disposed within the frame beneath the pair of slots and comprising:

a support base disposed against the base;

a lever arm comprising a first end and a second end; and a pivot pivotably coupling the lever arm to the support base between the first end and the second end of the lever arm.

7. The decorative mount of claim 6, further comprising a ledge extending from at least one of the base and the frame.

8. The decorative mount of claim 6, further comprising a decorative trim molding comprising an inner edge and an outer edge, wherein the inner edge defines an opening and the a pair of trim tabs extend from opposing sides of the outer edge, wherein the trim tabs fit within the pair of slots defined on opposing sides of an inner surface of the sidewall, releasably retaining the decorative trim molding to the frame.

* * * * *